United States Patent [19]

Terauchi

[11] 4,435,137

[45] Mar. 6, 1984

[54] SCROLL-TYPE FLUID COMPRESSOR WITH SCROLL STABILIZING MECHANISM

[75] Inventor: Kiyoshi Terauchi, Isesaki, Japan

[73] Assignee: Sanden Corporation, Japan

[21] Appl. No.: 249,657

[22] Filed: Mar. 31, 1981

[30] Foreign Application Priority Data

Apr. 5, 1980 [JP] Japan ..... 55-44073

[51] Int. Cl.[3] ..... F04C 18/02; F16D 3/04

[52] U.S. Cl. ..... 418/55; 418/57; 464/104

[58] Field of Search ..... 418/55, 57; 464/102, 464/104, 103

[56] References Cited

U.S. PATENT DOCUMENTS

| | | | |
|---|---|---|---|
| 2,813,409 | 11/1957 | Wolcott | 464/102 |
| 3,994,633 | 11/1976 | Shaffer | 418/55 |
| 3,994,635 | 11/1976 | McCullough | 418/57 |
| 4,065,279 | 12/1977 | McCullough | 418/55 |
| 4,082,484 | 4/1978 | McCullough | 418/57 |
| 4,160,629 | 7/1979 | Hidden | 418/55 |
| 4,259,043 | 3/1981 | Hidden | 418/55 |
| 4,303,379 | 12/1981 | Hiraga et al. | 418/55 |

FOREIGN PATENT DOCUMENTS

| | | | |
|---|---|---|---|
| 367086 | 2/1932 | United Kingdom | 418/55 |

*Primary Examiner*—John J. Vrablik

*Attorney, Agent, or Firm*—Schuyler, Banner, Birch, McKie & Beckett

[57] ABSTRACT

A scroll-type fluid compressor unit including a housing having a fluid inlet port and fluid outlet port and a fixed an an orbiting scroll member within the housing. Each scroll member has an end plate and a spiral element which are maintained angularly and radially offset so that both spiral elements interfit with line contacts between the spiral curved surfaces to define moving sealed off pockets. A thrust supporting means is engaged with a side surface of a portion of the orbiting scroll member for providing axial thrust support. An axial pushing means such as a spring-biased rod is engaged with the orbiting scroll member for pushing the orbiting scroll member against the thrust supporting means from the side of the orbiting scroll member which faces the fixed scroll member, so that axial slant of the orbiting scroll member is minimized.

10 Claims, 8 Drawing Figures

3
3

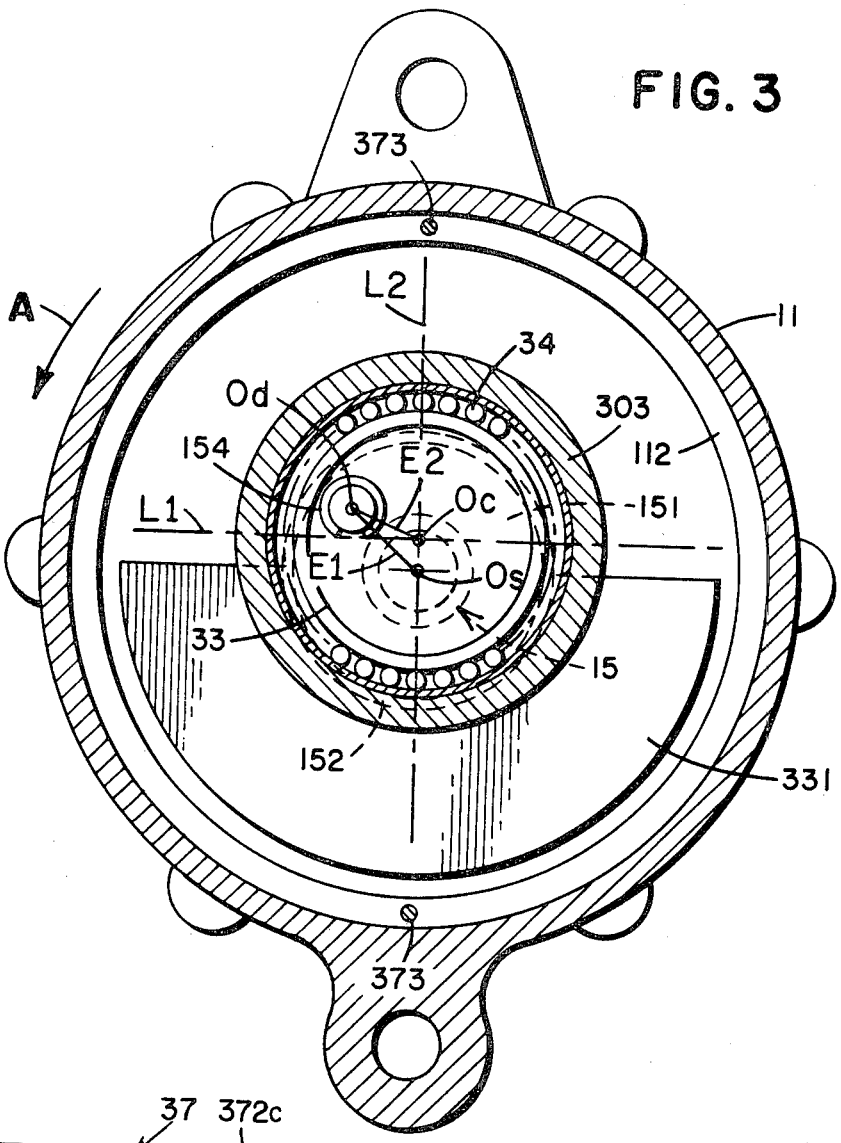
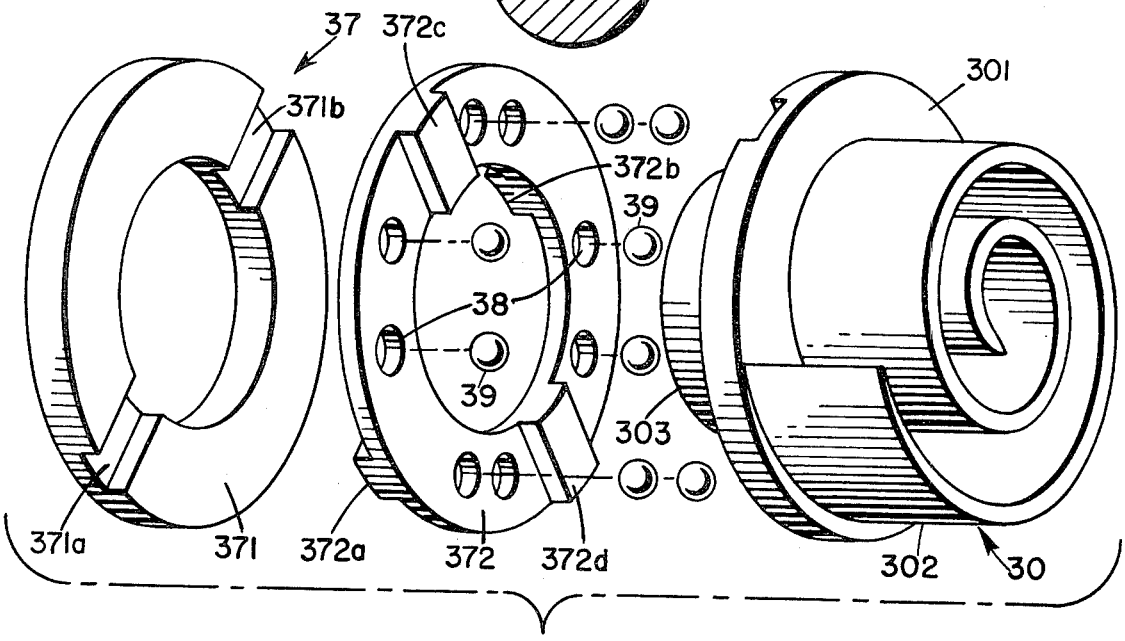
FIG. 4

SCROLL-TYPE FLUID COMPRESSOR WITH SCROLL STABILIZING MECHANISM

BACKGROUND OF THE INVENTION

This invention relates to rotary fluid displacement apparatus, and in particular, to fluid compressor units of the scroll type.

Scroll-type apparatus have been well known in the prior art as disclosed in, for example, U.S. Pat. No. 801,182, which discloses two scroll members each having an end plate and a spiroidal or involute spiral element. These scroll members are maintained angularly and radially offset so that both spiral elements interfit to make a plurality of line contacts between spiral curved surfaces to thereby seal off and define at least one pair of fluid pockets. The relative orbital motion of the scroll members shifts the line contact along the spiral curved surfaces and, therefore, the fluid pockets change in volume. The volume of the fluid pockets increases or decreases depending on the direction of orbital motion. Therefore, the scroll-type apparatus is applicable to compress, expand or pump fluids. When the scroll-type apparatus operates as a compressor, the fluid pocket moves to the center with a reduction of pocket volume by the relative orbital motion of the scroll members, to thereby compress the fluid in the pocket. Sealing at the line contacts of the spiral elements must be maintained if the apparatus is to function efficiently.

Each of the scroll members may be supported on a crank pin disposed at the end surface of a drive shaft for imparting relative orbital motion to both scroll members. That is, the scroll members are cantilevered. However, imbalance due to the orbiting motion of the scroll members causes the drive shafts and the scroll members to undergo axial slant, disrupting the line contact of both spiral elements.

In order to minimize this undesirable condition, one of the scroll members is fixedly attached to the compressor housing, while the other scroll member is supported on the crank pin of a drive shaft. However, the movement of the orbiting scroll member is eccentric with respect to the axis of rotation of the driveshaft, and axial slant may still easily occur. This leads to disruption of the line contact between the spirals increased vibration of the compressor during operation, and noise due to striking of the spiral elements.

In order to minimize axial slant, a supporting mechanism, such as a thrust bearing, has been devised for supporting the orbiting scroll member. An axial thrust force on the orbiting scroll member is produced by compressed fluid in the fluid pockets. Therefore, the orbiting scroll member is pushed against the thrust support mechanism to minimize axial slant. However, maximum thrust force is produced only during steady state operation. When the apparatus is not operating, the thrust force is not present. Hence, axial slant will occur during start-up and shut-down, when the thrust force is nonexistent or insufficient to press the orbiting scroll member against the thrust support mechanism. When an antifriction bearing is employed as the thrust support mechanism, fretting of the bearing and noise are caused by the axial slant.

SUMMARY OF THE INVENTION

It is a primary object of this invention to provide a scroll-type compressor unit wherein one of the scroll members is fixed, the other scroll member undergoes orbiting motion, and axial slant of the orbiting scroll member is prevented.

It is another object of this invention to provide a scroll-type compressor unit having a thrust support mechanism for the orbiting scroll member thereof, and a thrust force acting or pushing mechanism for exerting a thrust force on the orbiting scroll member.

It is still another object of this invention to provide a scroll-type compressor unit which accomplishes the above described objects, yet is simple in construction and is no less compact than a compressor unit not having these features.

A scroll-type compressor unit according to this invention includes a compressor housing having a fluid inlet port and a fluid outlet port. A fixed scroll member is fixedly disposed within the compressor housing and has a first end plate means from which a first wrap means extends. An orbiting scroll member has a second end plate means from which a second wrap means extends. The first and second wrap means interfit at an angular offset to make a plurality of line contacts to define at least one pair of sealed off fluid pockets.

A drive shaft is rotatably supported by the housing, with a drive pin, eccentrically disposed with respect to the axis of the drive shaft at an inner end of the drive shaft and connected to the orbiting scroll member for transmitting orbiting movement thereto. A rotation preventing means is provided for preventing the rotation of the orbiting scroll member during its orbital motion, whereby the fluid pocket changes volume by the orbital motion of the orbiting scroll member. Thrust supporting means are engaged with the side of the second end plate means opposite the side thereof from which the second wrap means extend, for providing axial stability to the orbiting scroll member when the orbiting scroll member is pushed against the thrust supporting means. Axial pushing means engages the orbiting scroll member for pushing the orbiting scroll member against the thrust supporting means from the side of the orbiting scroll member which faces the fixed scroll member.

The axial pushing means is disposed in the high pressure gas space of the fluid pocket, and comprises a rod disposed in the space between the fixed scroll member and the orbiting scroll member, and a compression spring which urges the rod against the orbiting scroll member to push the orbiting scroll member against the thrust supporting means.

Further objects, features and other aspects of this invention will be understood from the following detailed description of the preferred embodiments of this invention referring to the annexed drawings.

BRIEF DESCRIPTION OF THE DRAWINGS

FIG. 3 is a sectional view taken along a line 3—3 in FIG. 1;

FIG. 4 is an exploded perspective view of the rotation preventing mechanism with thrust supporting means in the embodiment of FIG. 1;

DETAILED DESCRIPTION OF THE PREFERRED EMBODIMENTS

Figure 1:
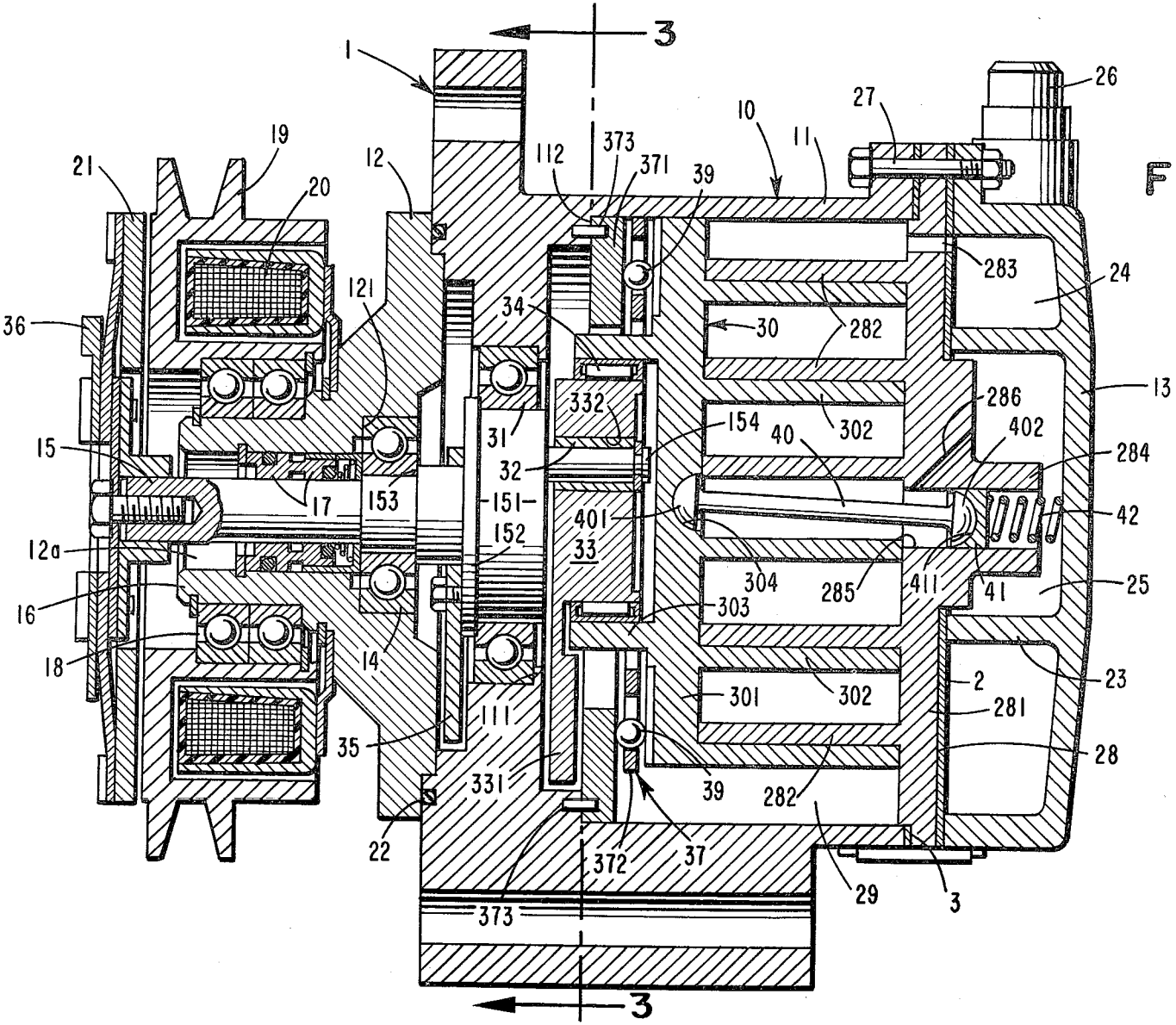
FIG. 1 is a vertical axial sectional view of a compressor unit according to one embodiment of this invention.

Referring to FIG. 1, a refrigerant compressor unit 1 of an embodiment shown includes a compressor housing 10 comprising a cylindrical housing 11, a front end plate 12 connected to the front end portion of the cylindrical housing 11 and a rear end plate 13 connected to the rear end portion of the cylindrical housing 11. An opening 12*a* is formed in the front end plate 12 and a drive shaft 15 is rotatably supported by a ball bearing 14 which is disposed in the opening. Front end plate 12 has a sleeve portion 16 projecting from the front surface thereof and surrounding the drive shaft 15 to define a shaft seal cavity. A shaft seal assembly 17 is assembled on drive shaft 15 within the shaft seal cavity. A pulley 19 is rotatably supported by a bearing means 18 which is disposed on the outer surface of sleeve portion 16. An electromagnetic annular coil 20 is fixed to the outer surface of sleeve portion 16 and is received in an annular cavity of the pulley 19. An armature plate 21 is elastically supported on the outer end of the drive shaft 15 which extends from sleeve portion 16. A magnetic clutch comprising pulley 19, magnetic coil 20 and armature plate 21 is thereby formed. Thus, drive shaft 15 is driven by an external drive power source, for example, a motor of a vehicle, through a rotational force applied to pulley 19 and transmitted through the magnetic clutch.

Front end plate 12 is fixed to the front end portion of cylindrical housing 11 by a bolt (not shown) to thereby cover an opening of cylindrical housing 11, and is sealed by an O-ring 22. Rear end plate 13 is provided with an annular projection 23 on its inner surface to partition a suction chamber 24 from discharge chamber 25. Rear end plate 13 has a fluid inlet port 26 and a fluid outlet port (not shown), which respectively are connected to the suction and discharge chambers 24, 25. Rear end plate 13 together with a circular end plate 281 are fixed to the rear end portion of cylindrical housing 11 by a bolt-nut 27. A circular end plate 281 of a fixed scroll member 28 is disposed in a hollow space between cylindrical housing 11 and rear end plate 13 and is secured to cylindrical housing 11. Reference numerals 2 and 3 represent gaskets for preventing fluid leakage past the outer perimeter of the circular end plate 281 and between suction chamber 24 and discharge chamber 25.

Fixed scroll member 28, having an involute center O (FIG. 8), includes the circular end plate 281 and a wrap means or spiral element 282 affixed to or extending from one side surface of circular end plate 281. Circular plate 281 is fixedly disposed between the rear end portion of cylindrical housing 11 and rear end plate 13. The opening of the rear end portion of cylindrical housing 11 is thereby covered by the circular plate 281. Spiral element 282 is disposed in an inner chamber 29 of cylindrical housing 11.

An orbiting scroll member 30 is also disposed in the chamber 29. Orbiting scroll member 30 also comprises a circular end plate 301 and a wrap means or spiral element 302 affixed to or extending from one side surface of circular plate 301. The spiral element 302 and spiral element 282 of fixed scroll member 28 interfit at an angular offset of 180° and at a predetermined radial offset. Orbiting scroll member 30 is connected to a drive mechanism and to a rotation preventing/thrust bearing mechanism. These last two mechanisms effect orbital motion at circular radius Ro by rotation of drive shaft 15, to thereby compress fluid passing through the compressor unit.

Generally, radius Ro of orbital motion is given by:

$$Ro = \frac{\text{(pitch of spiral element)} - \text{2(wall thickness of spiral element)}}{2}$$

Figure 8:
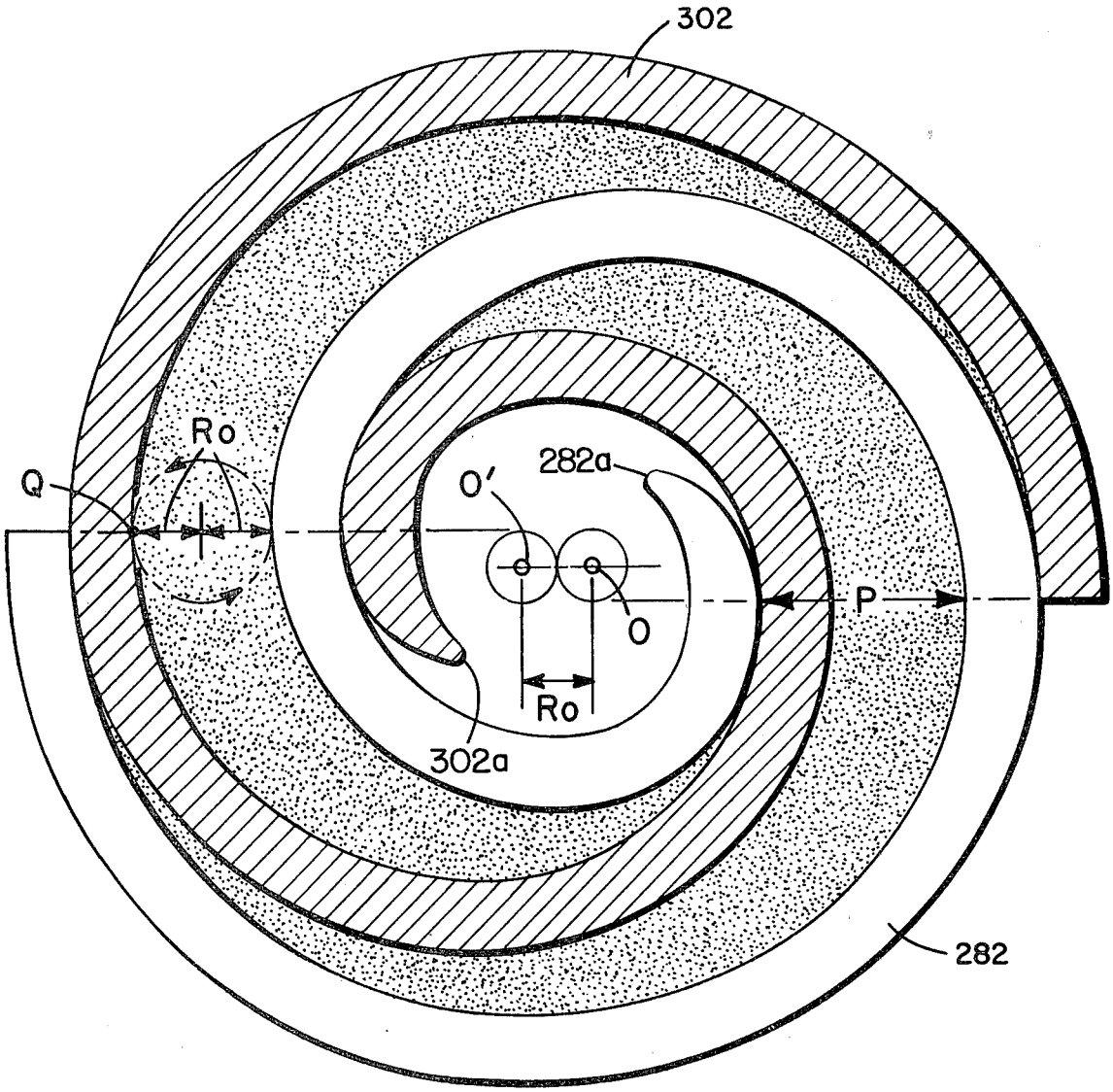
FIG. 8 is a sectional view illustrating the spiral elements of the fixed and orbiting scroll members.

As seen in FIG. 8, the pitch (P) of the spiral elements can be defined by $2\pi r_g$, where $r_g$ is the involute generating circle radius. The radius of orbital motion Ro is also illustrated in FIG. 8 as a locus of an arbitrary point Q on orbiting scroll member 30. The spiral element 302 is placed radially offset from the spiral element 282 of fixed scroll member 28 by the distance Ro. Thereby, orbiting scroll member 30 is allowed to undergo the orbital motion of a radius Ro by the rotation of drive shaft 15. As the scroll member 30 orbits, the line contact between both spiral elements 282 and 302 shifts to the center of the spiral elements along the surface of the spiral elements. Fluid pockets defined between the spiral elements 282 and 302 move to the center with a consequent reduction of volume, to thereby compress the fluid in the pockets.

Figure 2:
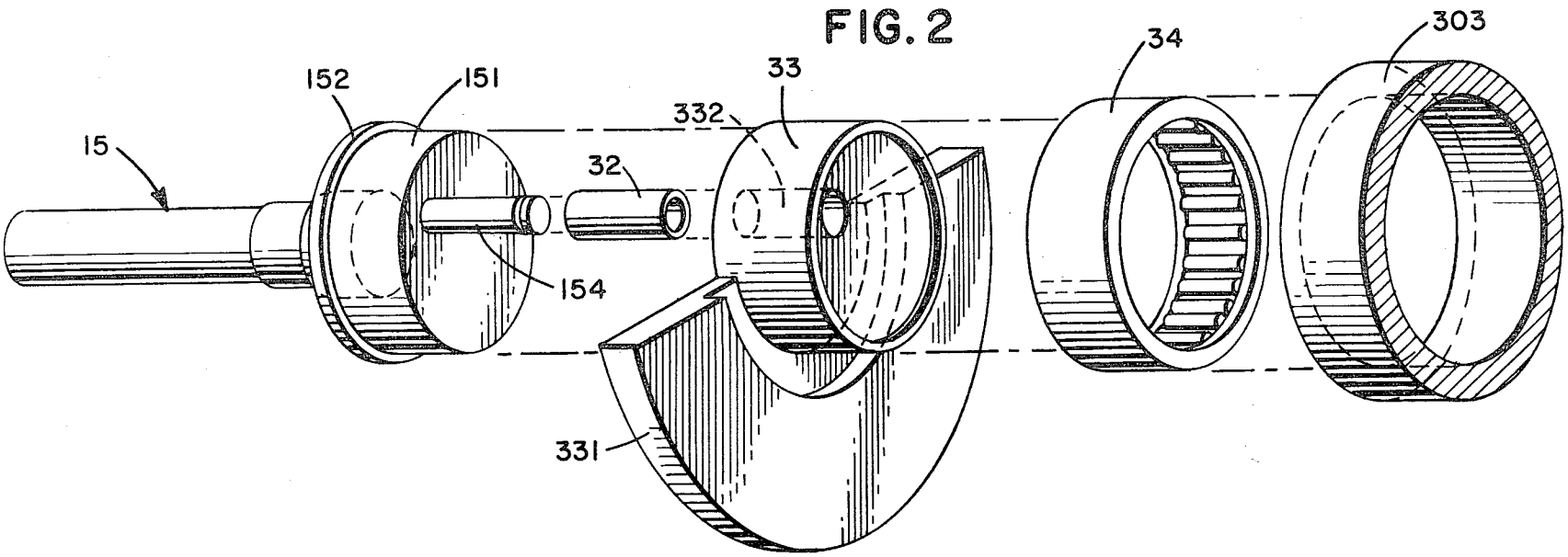
FIG. 2 is an exploded perspective view of the driving mechanism in the embodiment of FIG. 1.

Referring to FIGS. 1, 2 and 3, a driving mechanism of orbiting scroll member 30 will be described. Drive shaft 15, which is rotatably supported by front end plate through a ball bearing 14, is formed with a disk portion 151. Disk portion 151 is rotatably supported by ball bearing 31 which is disposed in a front end opening of cylindrical housing 11. A inner ring of the ball bearing 31 is fitted against a collar 152 formed with disk portion 151, and the outer ring is fitted against a collar 111 formed at the front end opening of cylindrical housing 11. An inner ring of ball bearing 14 is fitted against a stepped portion 153 of driving shaft 15 and an outer ring of ball bearing 14 is fitted against a shoulder portion 121 of the opening of front end plate 12. Therefore, driving shaft 15, and ball bearings 14 and 31 are supported for rotation without axial motion.

A crank pin or drive pin 154 axially projects from an end surface of disk portion 151 and, hence, from an end of drive shaft 15, and is radially offset from the center of drive shaft 15.

Circular plate 301 of orbiting scroll member 30 is provided with a tubular boss 303 axially projecting from an end surface opposite to the side thereof from which spiral element 302 extends or is affixed. A discoid or short axial bushing 33 if fitted into boss 303, and is rotatably supported therein by bearing means, such as a needle bearing 34. Bushing 33 has a balance weight 331 which is shaped as a portion of a disc or ring and extends radially from the bushing 33 along a front surface thereof. An eccentric hole 332 is formed in the bushing 33 radially offset from the center of the bushing 33. Drive pin 154 is fitted into the eccentrically disposed hole 332 within which a bearing 32 is applied. Bushing 33 is therefore driven by the revolution of drive pin 154 and permitted to rotate by a needle bearing 34.

Respective placement of center Os of shaft 15, center Oc of bushing 33, and center Op of hole 332 and thus of drive pin 154, is shown in FIG. 3. In the position shown in FIG. 3, the distance between Os and Oc is the radius Ro of orbital motion, and when drive pin 154 is fitted to eccentric hole 332, center Od of drive pin 154 is placed, with respect to Os, on the opposite side of a line L1 which passes through Oc and is perpendicular to a line L2 passing through Oc and Os, and also beyond the line L2 through Oc and Os in direction of rotation A of shaft 15.

In this construction of a driving mechanism, center Oc of busing 33 is permitted to swing about the center Od of drive pin 154 at a radius E2, as shown in FIG. 3. When drive shaft 15 rotates, a drive force Fd is exerted at center Os to the left, and a reaction force FR of gas compression appears at center Oc to the right, both forces being parallel to line L1. Therefore, the arm Od-Oc can swing outwardly by creation of the moment generated by Fd and Fr. Therefore, spiral element 302 of orbiting scroll member 30 is forced toward spiral element 282 of fixed scroll member 28 and, because of the interfitting line contact between spiral elements 282 and 302, the orbiting scroll member 30 necessarily orbits with the radius Ro around center Os of drive shaft 15. The rotation of orbiting scroll member 30 is prevented by a rotation preventing mechanism, described more fully hereinafter, whereby orbiting scroll member 30 orbits while maintaining its angular orientation. The fluid pocket moves because of the orbital motion of orbiting scroll member 30 to thereby compress the fluid.

When fluid is compressed by orbital motion of orbiting scroll member 30, reaction force Fr, caused by the compression of the fluid, acts on spiral element 302. The reaction force FR gives rise to an urging force which acts at the line contact between both spiral elements 302 and 282 to urge spiral element 302 into engagement with spiral element 282 whereby a seal of the fluid pockets is attained. In addition, center Oc of bushing 33 is rotatable around center Od of drive pin 154, therefore, if a pitch of a spiral element or a wall thickness of a sprial element has a dimensional error, due to manufacturing inaccuracy or wear, distance Oc-Os changes to correspond to the error. Orbiting scroll member 30 thereby moves smoothly along the line contacts between the spiral elements.

If bush 33 is not provided with balance weight 331, a centrifugal force F1 caused by orbiting motion of orbiting scroll member 30, bearing 34 and bush 33 is added to the urging force of spiral element 302 acting on spiral element 282. Therefore, the contact force between the spiral elements 282, 302 would also increase as shaft speed increases. Friction force between spiral element 302 and 282 would thereby be increased, and wearing of both spiral elements and also mechanical friction loss would increase. In a situation where the needle bearing 34 is omitted, the centrifugal force F1 would arise from the orbiting of the scroll member 30 and the bushing 33.

Therefore, if bushing 33 is provided with a properly designed balance weight 331, centrifugal force F1 can be cancelled by a centrifugal force F2 of the balance weight. The mass of the balance weight 331 is selected so that the centrifugal force F2 is equal in magnitude to the centrifugal force F1 and located so that the centrifugal forces F1 and F2 are opposite in direction. Wear of both spiral elements will thereby also be decreased; the sealing force of fluid pockets will be attained by the contact between the spiral elements, and the orbiting scroll member will be moved smoothly.

While suitable sealing force of the fluid pocket is accomplished by using bushing 33 having balance weight 331, a centrifugal force F1 arises due to orbiting of scroll member 30, bearing 34 and bushing 33 (except balance weight); and centrifugal force F2 arises due to orbiting of balance weight 331. The centrifugal forces F1, F2 are equal in magnitude, however, direction of the forces is opposed. Therefore, if the acting point of these forces is axially offset, a moment arises and vibration of the unit can occur. Vibration is prevented by providing balance weight 35, 36 on drive shaft 15. The angular and axial positioning of balance weights 35, 36 is such that the moment arising from the centrifugal forces produced by their rotation cancels out the moment arising from centrifugal forces F1, F2, in a manner well known to those skilled in the art of dynamic shaft balancing.

Referring to FIG. 4 and FIG. 1, a rotation preventing/thrust bearing means37 which is formed integral with a thrust supporting means will be described. Rotation preventing/thrust bearing means 37 is disposed to surround boss 303 and is comprised of a fixed ring 371 and an Oldham ring 372. Fixed ring 371 is secured to a stepped portion 112 of the inner surface of cylindrical housing 11 by pins 373. Fixed ring 371 is provided with a pair of keyways **371*a*, 371*b* in an axial end surface facing orbit scroll member 30. Oldham ring 372 is disposed in a hollow space between fixed ring 371 and circular plate 301 of orbiting scroll member 30. Oldham ring 372 is provided with a pair of keys 372*a*, 372*b* on the surface facing fixed ring 371, which are received in keyways 371*a*, 371*b*. Therefore, Oldham ring 371 is slidable in the radial direction by the guide of keys 372*a*, 372*b* within keyways 371*a*, 371*b*. Oldham ring 372 is also provided with a pair of keys 372*c*, 372*d* on its opposite surface. Keys 372*c*, 372*d* are arranged along a diameter perpendicular to the diameter along which keys 372*a*, 372*b* are arranged. Circular plate 301 of orbiting scroll member 30 is provided with a pair of keyways (in FIG. 4 only one kayway 301*a* is shown; the other keyway is disposed diametrically opposite to keyway 301*a*) on the surface facing Oldham ring 392, in which are received keys 372*c*, 372*d* and formed outside the diameter of boss 303. Therefore, orbiting scroll member 30 is slidable in a radial direction on guide keys 372*c*, 372*d* withinthe keyways of the circular plate 301. Again, this keying prevents rotation of orbiting scroll member 30**.

Accordingly, orbiting scroll member is slidable in one radial direction with Oldham ring 372, and is independently slidable in another radial direction which is perpendicular to the first radial direction. Therefore, rotation of orbiting scroll member 30 is prevented, but it is permitted to move in two radial directions perpendicular to one another.

In addition, Oldham ring 372 is provided with a plurality of holes 38. A bearing means, such as balls 39 each having a diameter which is larger than the thickness of Oldham ring 372, are disposed in holes 38. Balls 39 contact and roll on the surfaces of fixed ring 371 and circular plate 301. Therefore, the thrust load from orbiting scroll member 30 is supported on fixed ring 371 through balls 39.

The compressor unit as shown by FIG. 1 is provided with an axial pushing means for pushing orbiting scroll member 30 against the thrust supporting means to stabilize the orbital motion of orbiting scroll member 30.

Circular plate 281 of fixed scroll member 28 is provided with an annular sleeve portion 284 at the center portion thereof, and sleeve portion 284 extends to discharge chamber 25. Sleeve portion 284 is formed with a penetration hole 285 for communication between discharge chamber 25 and the fluid pocket. A sliding block 41 is disposed in hole 285 and is formed with a spherically concave seat 411. One or more discharge holes 286 which communicate discharge chamber 25 and the central fluid pocket are formed around the opening of hole 285. The center of circular plate 301 of orbiting scroll member 30 is formed with a spherically concave seat 304 in the same surface to which spiral element 302 is affixed. Spherical seats 304 and 411 face inwardly at opposite ends of the central fluid pocket.

A rod 40 is disposed in the central fluid pocket. Both ends of rod 40 are provided with spherically convex tips 401, 402. The curvatures of tips 401 and 402 respectively conform to and engage the curvatures of seats 304 and 411 so that rod 40 is permitted freedom of conical movement. Sliding block 41 is pushed against rod 40 by a compression spring 42 which is disposed between the inner surface of discharge chamber 25 and sliding block 41. Therefore, orbiting scroll member 30 is pushed against the thrust supporting means, which comprises ball bearings 39 and fixed rings 371. Hence, orbiting scroll member 30 is always stably supported by the thrust supporting means to prevent axial slant. The inner end portions **282*a*, 302*a* (FIG. 8) of spiral elements 282, 302 extend inwardly to near the center of the base circle of the spiral curve, but not far enough to interfere with rod 40**, which is disposed in the center fluid pocket.

In the operation of the above described compressor unit, when drive shaft 15 is rotated by an external drive power source through the pulley and magnetic clutch, orbiting scroll member 30 undergoes orbital motion of radius Ro by the rotation of drive shaft 15. At this time, rotation of orbiting scroll member 30 is prevented by rotation preventing/thrust bearing means 37. Therefore, a fluid, for example, refrigerant gas, introduced into chamber 29 through inlet port 26, suction chamber 24 and hole 283 is taken into the fluid pockets from the outer end portions of both spiral elements 282, 302, and is gradually compressed, because the fluid pockets gradually shift toward the center with a reduction of their volume by the orbital motion of orbiting scroll member 30. The compressed fluid is discharged into discharge chamber 25 through discharge hole 286, and, therefrom, discharged through outlet port to, for example, a cooling circuit. Now, orbiting scroll member 30 is always pushed against the thrust supporting means by the preloaded compression spring 42 through sliding block 41 and rod 40. Therefore, axial slant of orbiting scroll member 30 is prevented.

Figure 5:
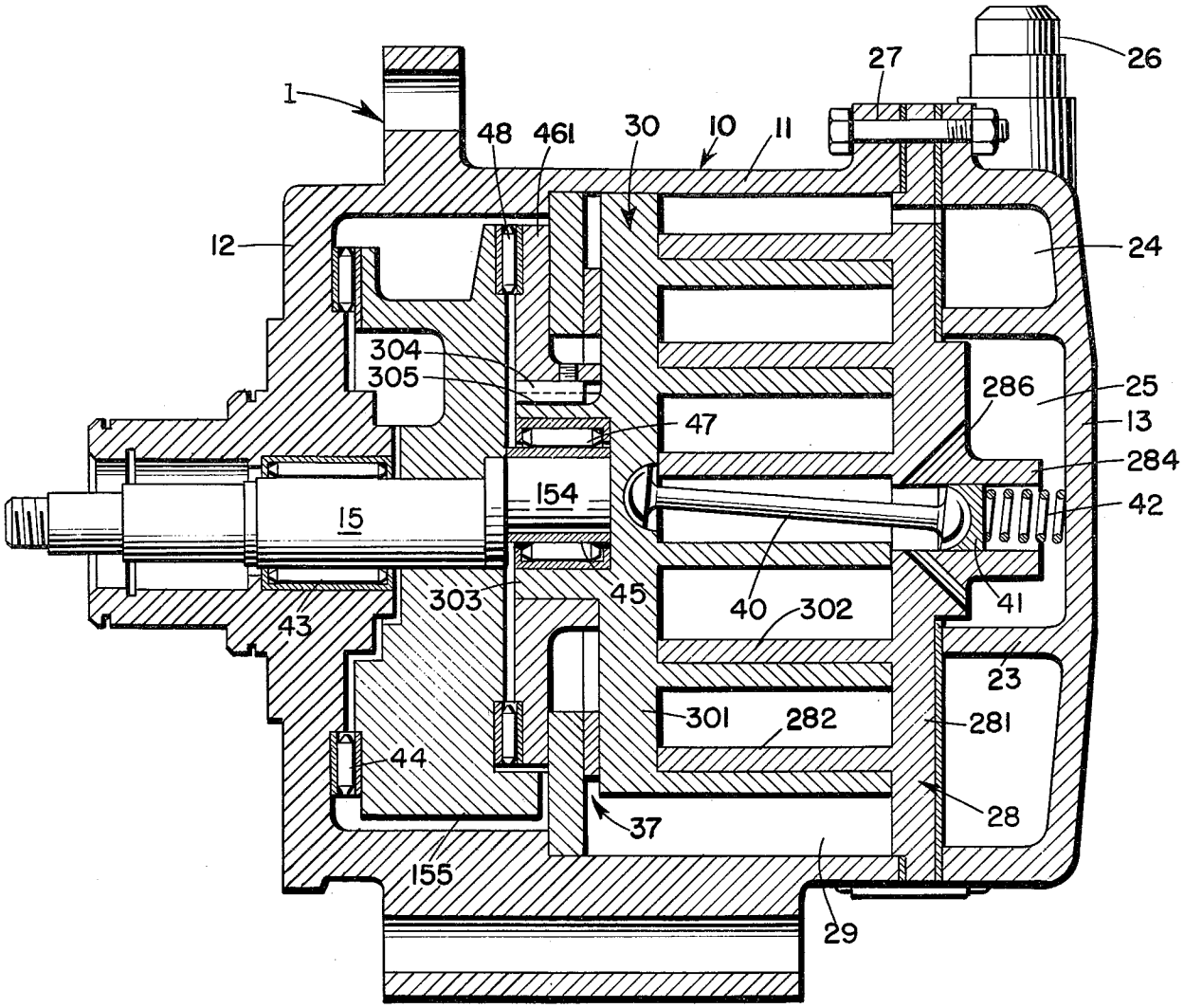
FIG. 5 is a vertical axial sectional view of a compressor according to another embodiment of this invention, with some parts omitted for the sake of simplicity.

Referring to FIG. 5, another embodiment is shown which illustrates a modification of the thrust supporting mechanism, and which is characterized in that drive shaft 15 is rotatably supported by a radial needle bearing 43 in an opening **12*a* formed in front end plate 12. A disk rotor 155 is fixedly mounted on an inner end of drive shaft 15 and is borne on the inner surface of front end plate 12 by a thrust needle bearing 44 disposed concentrically with drive shaft 15. A crank pin or drive pin 154 is also connected to the inner end of drive shaft 15 to axially project from the end surface of rotor 155. Drive pin 154 is radially offset from drive shaft 15 by a predetermined orbit radius and is formed integral with drive shaft 15**.

Circular plate 301 of orbiting scroll member 30 is provided with an axial boss 303. Drive pin 154 is fitted into boss 303 with a bushing 45 and a radial needle bearing 47 therebetween, so that orbiting scroll member 30 is rotatably supported on drive pin 154.

A sleeve 46 having a radial flange 461 is fitted onto boss 303 non-rotatably by means of a key 304 and keyway 305. Radial flange 461 is supported on the end surface of disk rotor 155 by a thrust needle bearing 48 which is disposed concentrically with drive pin 154. Hence, the thrust load from orbiting scroll member 30 is supported on front end plate 12 through disk rotor 155. Therefore, the rotation of drive shaft 15 effects the orbital motion of orbiting scroll member 30 together with flange member 46.

Rotation preventing means 37 is disposed between circular plate 301 of orbiting scroll member 30 and radial flange 461 of sleeve 46. Construction of the rotation preventing means 27 is substantially the same as that shown in FIG. 1 and FIG. 4.

Figure 6:
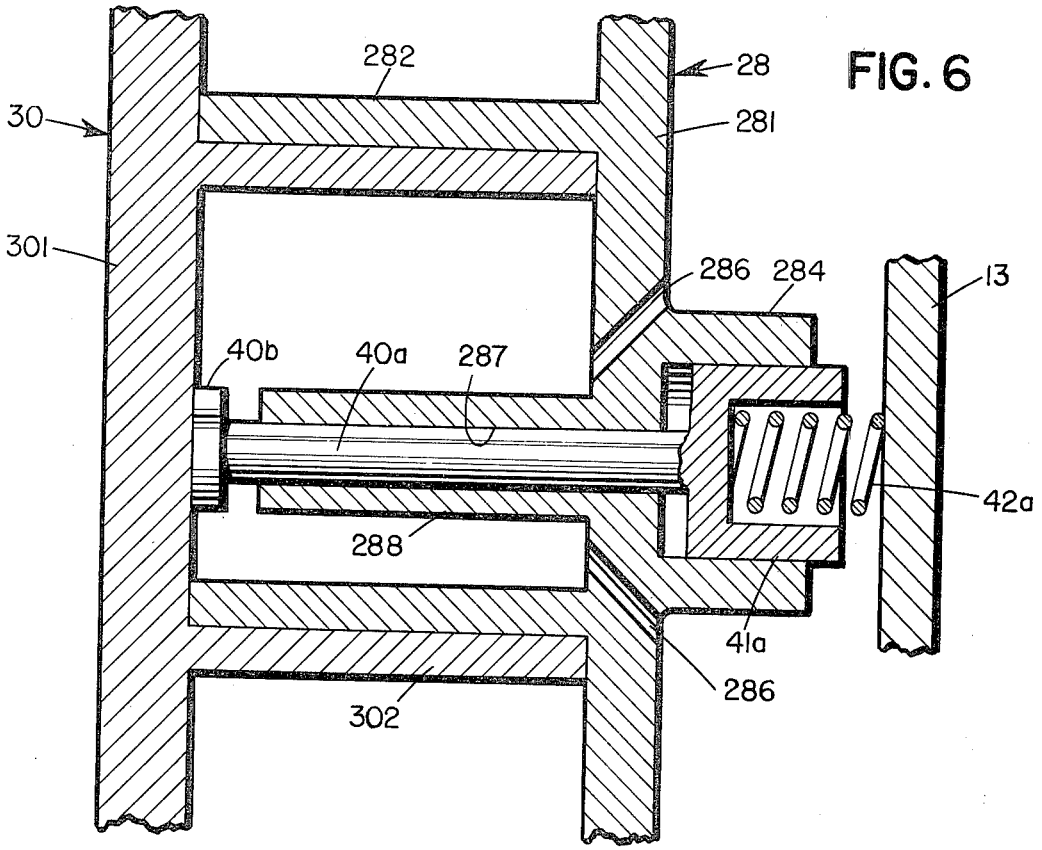
FIG. 6 is a vertical axial sectional view of a main part of a compressor according to another embodiment of this invention.
Figure 7:
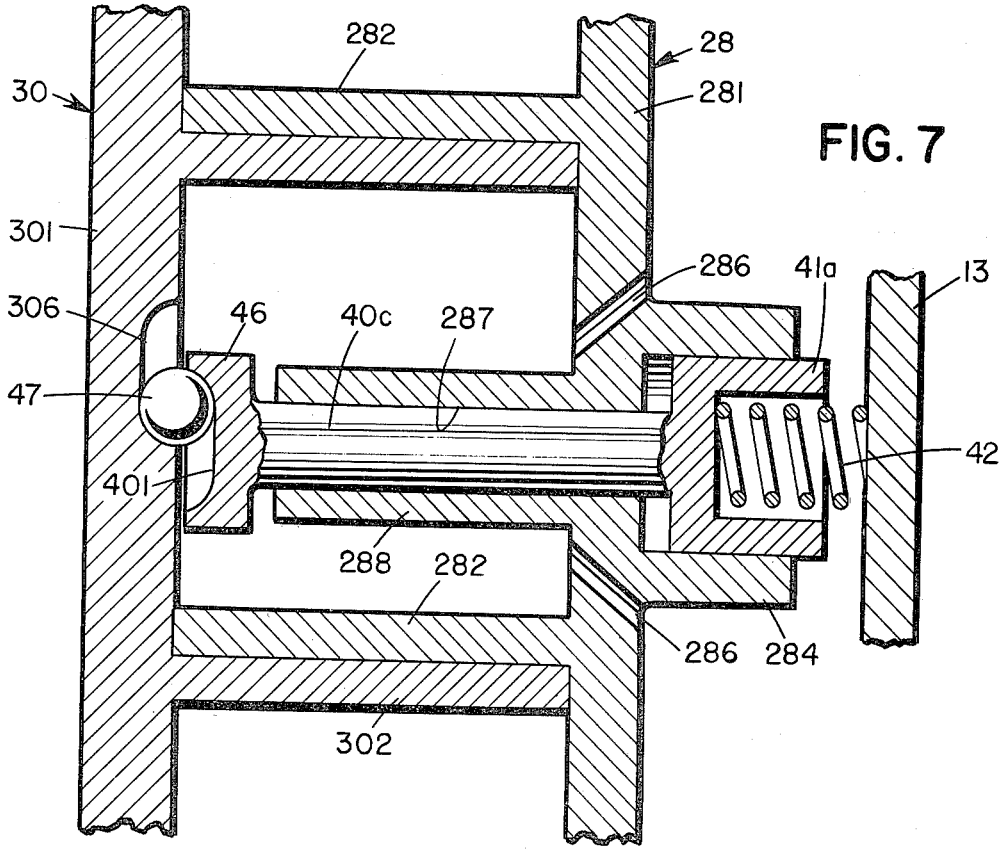
FIG. 7 is a vertical axial sectional view of a main part of a compressor according to still another embodiment of this invention.

Referring to FIG. 6 and FIG. 7, two other embodiments are shown which incorporate a modification of the axial pushing means, and which is characterized in that circular plate 281 of fixed scroll member 28 is provided with an annular sleeve portion 284 which extends into discharge chamber 25 at the center portion thereof. Circular plate 281 is formed with a small hole 287 and is provided with an annular sleeve portion 288 projecting from the surface of circular plate 281 and surrounding hole 287. Rod **40*a* is slidable in hole 287 in sleeve portion 288. In the case of FIG. 6, the end portion 40*b* of rod 40*a* slidably contacts circulr plate 301 of orbiting scroll member 30 and has a flat surface formed thereon. Therefore, orbiting scroll member 30 and the end portion of rod 40*a* are in sliding contact. On the opposite end of rod 40*a* a sliding block 41*a* is disposed in sleeve portion 284 and is pushed against circular plate 281 by compression spring 42 which is disposed between sliding block 41*a* and the inner surface of end plate 13. Therefore, orbiting scroll member 30 is pushed against the thrust supporting mechanism (such as in FIG. 5) through sliding block 41*a* and rod 40*a* by the preloaded spring 42**.

Alternatively (FIG. 7), the enlarged end portion 46 of rod **40*c* (similar to rod 40*a*) which faces circular plate 301 is formed with a circular recess 401, and the facing surface of circular plate 301 is provided with a similar recess 306. A ball 47 is disposed between recesses 306 and 401. Therefore, orbiting scroll member 30 and rod 40*c* form a friction reducing ball bearing contact as shown in FIG. 7**.

This invention has been described in detail in connection with preferred embodiments, but these are examples only and this invention is not restricted thereto. It will be easily understood by those skilled in the art that other variations and modifications can be easily made within the scope of this invention.

I claim:

1. In a scroll-type fluid compressor including a housing havibng a fluid inlet port and a fluid outlet port, a fixed scroll member fixedly disposed within said housing and having first end plate means from which first wrap means extend, an orbiting scroll member having second end plate means from which second wrap means extend and said first and second wrap means interfitting at an angular offset to make a plurality of line contacts to define at least one pair of sealed off fluid pockets, a drive shaft rotatably supported by said housing, a drive pin eccentrically disposed with respect to the axis of the drive shaft at an iner end of said drive shaft and connected to said orbiting scroll member for transmitting orbiting movement, and a rotation preventing means for preventing the rotation of said orbiting scroll member during the orbital motion of said orbiting scroll member, whereby said fluid pockets change volume by the orbital motion of said orbiting scroll member and merge with a central high pressure fluid space, the improvement comprising thrust supporting means engaged with the side of said second end plate means opposite to the side thereof from which said second wrap means extend, for providing axial thrust support to said orbiting scroll member, and axial pushing means including a separate pushing member, located generally centrally of said scroll members in said high pressure fluid space, in engagement with said orbiting scroll member generally at the center thereof for mechanically pushing said orbiting scroll member against said thrust supporting means from the side of said orbiting scroll member which faces said fixed scroll member, to minimize axial slant of sai orbiting scroll member.

2. The improvement as claimed in claim 1, wherein said axial pushing means comprises a hole in said first end plate means, a rod extending between said fitted scroll member and said orbiting scroll member with one end of said rod fitted in said hole and the other end of said rod in engagement with said orbiting scroll member, and a compression spring disposed in said hole between said one end of said rod and an abutment means.

3. The improvement as claimed in claim 2, wherein the ends of said rod are spherically convex and said axial pushing means further comprises a spherically concave seat at the center of said orbiting scroll, and a slide block disposed in said hole having a facing spherically concave seat, said slide block being disposed between said rod and said compression spring, with the ends of said rod in engagement with said seats.

4. The improvement as claimed in claim 2, wherein said fixed scroll member is provided with an annular sleeve projecting from said first end plate means and surrounding said rod, and each end of said rod is provided with a disk portion.

5. The improvement as claimed in claim 2, wherein said fixed scroll member is provided with an annular sleeve projecting from said first end plate means and surrounding said rod, said axial pushing means further comprising a depression in the end of said rod adjacent said orbiting scroll member, a depression in said second end plate means facing the depression in the end of said rod, and a ball bearing disposed in the hollow space between said depressions.

6. The improvement as claimed in claim 2 wherein said housing has a discharge chamber adjacent said fixed scroll member on the side of said first end plate means opposite to the side thereof from which said first wrap means extends, said outlet port communicates with said discharge chamber, said first end plate means has a discharge bore therethrough communicating with said said high pressure fluid space near the center of said first wrap means and said discharge chamber, and said hole in said first end plate means extends completely therethrough so that said compression spring bears against the housing wall of said discharge chamber.

7. The improvement as claimed in claim 1, wherein said thrust supporting means comprises a thrust ball bearing means integral with said rotation preventing means.

8. The improvement as claimed in claim 7, wherein said rotation preventing means comprsies a fixed ring member fixedly disposed within said compressor housing and provided with a pair of keyways, a sliding ring member disposed in a hollow space between said fixed ring member and said orbiting scroll member provided with a plurality of spaced holes therearound and having a first pair of keys on one face thereof in engagement with said keyways of said fixed ring member, and a second pair of keys on the other face thereof arranged along a diameter perpendicular to the diameter along which said first pair of keys are disposed, said second end plate means of said orbiting scroll member provided with a pair of keyways facing said sliding ring member and in engagement with said second pair of keys, and a ball disposed in each of said holes.

9. The improvement as claimed in claim 1, wherein said thrust supporting means comprises a thrust needle bearing means.

10. The improvement as claimed in claim 9, wherein said thrust needle bearing means comprises an axial boss projecting from the side of said second end plate means of said orbiting scroll member opposite to the side thereof from which said second wrap means extends, a flange member having a radial flange fitted onto said boss, a disk rotor on said drive shaft, a thrust needle bearing between said disk rotor and said housing, and a thrust needle bearing disposed between said radial flange of said flange member and said disk rotor.

* * * * *